US008084725B1

(12) United States Patent
Dryer

(10) Patent No.: US 8,084,725 B1
(45) Date of Patent: Dec. 27, 2011

(54) METHODS AND APPARATUS FOR FAST ACTION IMPULSE THRUSTER

(75) Inventor: Richard L. Dryer, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 471 days.

(21) Appl. No.: 12/389,478

(22) Filed: Feb. 20, 2009

Related U.S. Application Data

(60) Provisional application No. 61/049,532, filed on May 1, 2008.

(51) Int. Cl.
*F42B 10/00* (2006.01)
*F42B 15/01* (2006.01)
*F42B 15/00* (2006.01)

(52) U.S. Cl. ..... 244/3.21; 102/200; 102/206; 102/382; 102/384; 102/501; 244/3.1; 244/3.15; 244/3.22

(58) Field of Classification Search ..... 244/3.1–3.3; 89/1.11; 102/200, 206, 217, 382, 384, 501, 102/430, 437, 438, 439, 473, 480
See application file for complete search history.

(56) References Cited

U.S. PATENT DOCUMENTS

| | | | | |
|---|---|---|---|---|
| 3,398,916 | A * | 8/1968 | Van Vyve | 244/3.11 |
| 3,860,199 | A | 1/1975 | Dunne | |
| 3,977,629 | A * | 8/1976 | Tubeuf | 244/3.22 |
| 4,009,661 | A * | 3/1977 | Dodd | 102/480 |
| 4,408,735 | A * | 10/1983 | Metz | 244/3.22 |
| 4,463,921 | A * | 8/1984 | Metz | 244/3.22 |
| 4,482,107 | A * | 11/1984 | Metz | 244/3.22 |
| 5,647,558 | A * | 7/1997 | Linick | 244/3.11 |
| 5,695,152 | A * | 12/1997 | Levy | 244/3.13 |
| 5,836,540 | A * | 11/1998 | Romer et al. | 244/3.16 |
| 6,138,945 | A * | 10/2000 | Biggers et al. | 244/3.22 |
| 6,178,741 | B1 * | 1/2001 | Nelson et al. | 244/3.22 |
| 6,347,763 | B1 * | 2/2002 | Harkins et al. | 244/3.21 |
| 6,367,735 | B1 * | 4/2002 | Folsom et al. | 244/3.22 |
| 6,584,907 | B2 * | 7/2003 | Boucher et al. | 102/217 |
| 6,889,610 | B2 * | 5/2005 | Boucher et al. | 102/217 |
| 6,889,935 | B2 * | 5/2005 | O'Dwyer | 244/3.21 |
| 7,004,423 | B2 * | 2/2006 | Folsom et al. | 244/3.22 |
| 7,416,154 | B2 * | 8/2008 | Bittle et al. | 244/3.22 |
| 7,494,089 | B2 * | 2/2009 | Williams et al. | 244/3.16 |
| 7,631,600 | B2 * | 12/2009 | O'Dwyer | 102/438 |
| 7,814,696 | B2 * | 10/2010 | Rapp et al. | 102/437 |

(Continued)

FOREIGN PATENT DOCUMENTS

FR 2492966 A1 4/1982

(Continued)

*Primary Examiner* — Bernarr Gregory
(74) *Attorney, Agent, or Firm* — The Noblitt Group, PLLC

(57) ABSTRACT

Methods and apparatus for a fast action impulse thruster according to various aspects of the present invention may comprise a projectile comprising an impulse thruster system. The impulse thruster system may comprise a guidance system and a fast action impulse thruster system. The guidance system may control the trajectory of the projectile, for example by activating the fast action impulse thruster system to adjust the projectile's trajectory. The fast action impulse thruster system may be configured such that it may provide an impulse force to guide the projectile with a reaction time that is not affected by the rotational velocity of the projectile. The impulse force may be achieved by ejecting at least one mass from the projectile at high velocity such that a resulting momentum exchange may alter the trajectory of the projectile. The fast action impulse thruster system may also be configured in such a way so as to provide a significant improvement to the overall safety during the production, assembly, and handling of the projectile.

20 Claims, 2 Drawing Sheets

U.S. PATENT DOCUMENTS

| | | | | |
|---|---|---|---|---|
| 7,851,732 | B2 * | 12/2010 | Brinkerhoff et al. | 244/3.21 |
| 7,947,938 | B2 * | 5/2011 | Dryer | 244/3.21 |
| 2003/0075069 | A1 | 4/2003 | Boucher et al. | |
| 2005/0103925 | A1 | 5/2005 | Folsom et al. | |
| 2008/0223977 | A1 | 9/2008 | Dryer | |

FOREIGN PATENT DOCUMENTS

| | | | |
|---|---|---|---|
| WO | 0052414 | A1 | 9/2000 |

* cited by examiner

METHODS AND APPARATUS FOR FAST ACTION IMPULSE THRUSTER

CROSS-REFERENCES TO RELATED APPLICATIONS

This application claims the benefit of U.S. Provisional Patent Application No. 61/049,532, filed May 1, 2008, and incorporates the disclosure in its entirety by reference.

BACKGROUND OF INVENTION

In the realm of enemy combat, ballistics are continually developed in an attempt to acquire a combative edge. For example, long range projectiles, such as missiles, mortars, and the like were developed to more beneficially engage the enemy at long ranges to limit close range, hand to hand or close fire combat. However, the effectiveness of such long range projectiles may be limited by a variety of constraints. Two such common constraints are limited firing range and/or inaccurate targeting. For instance, an artillery-fired projectile may comprise a limited range due to a maximum muzzle velocity for a given combination of the projectile, a barrel to direct the launch of the projectile, and a propellant to "drive" the projectile. Frequently, targets beyond the limited range cannot be effectively reached. Additionally, the artillery-fired projectile may comprise of a fixed trajectory upon firing. As a consequence, if the fixed trajectory is not accurately aligned to the intended target, upon firing the projectile, the projectile may miss its intended target. Other factors can also reduce the accuracy of the projectile, such as, atmospheric conditions, variations in the aerodynamic properties of a given projectile, and/or the like.

Limited range and accuracy may have a number of negative effects in combat situations. For example, to compensate for inaccurately launched projectiles, launches of multiple projectiles may be needed to ultimately strike the intended target. Thus, the time to launch multiple projectiles may extend the engagement of the enemy, which in turn increases the cost of enemy engagement operations and jeopardize the lives of combatants who must experience such extended engagement times to service the enemy targets.

A number of systems have been developed to overcome these constraints. For instance, to overcome limited range, integrated rocket systems such as an M5419A1 rocket assisted projectile have been developed with additional propulsion. While integrated rockets comprising additional propulsion may increase range, these types of rocket systems do not necessarily improve accuracy.

To improve accuracy, some projectiles may comprise guidance systems comprising control surfaces that are configured to direct the projectile during flight. For example, these guidance systems may comprise deployable fins that modify the aerodynamic properties of the projectile to affect its trajectory. While guidance systems may serve to direct the flight of the projectile, such guidance systems may also add substantial complexity and weight to the projectile, and the inherent drag of the aerodynamic controls may further reduce the range of the projectile. Moreover, conventional flight control surfaces may be less effective on projectiles comprising large rotational velocities because the control surfaces cannot react quick enough to overcome the rotation of the projectile.

SUMMARY OF THE INVENTION

Methods and apparatus for a fast action impulse thruster according to various aspects of the present invention may comprise a projectile comprising an impulse thruster system. The impulse thruster system may comprise a guidance system and a fast action impulse thruster system. The guidance system may control the trajectory of the projectile, for example by activating the fast action impulse thruster system to adjust the projectile's trajectory. The fast action impulse thruster system may be configured such that it may provide an impulse force to guide the projectile with a reaction time that is not affected by the rotational velocity of the projectile. The impulse force may be achieved by ejecting at least one mass from the projectile at high velocity such that a resulting momentum exchange may alter the trajectory of the projectile. The fast action impulse thruster system may also be configured in such a way so as to provide a significant improvement to the overall safety during the production, assembly, and handling of the projectile.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks and steps may be realized by any number of technologies, manufacturing techniques, and/or operational sequences configured to perform the specified functions and achieve the various results. For example, the present invention may employ various materials, software programs, communications systems, and data storage systems, for example, satellite positioning systems, inertial guidance systems, and/or the like, which may carry out a variety of functions. In addition, the present invention may be practiced in conjunction with any number of applications including guided projectile systems, guided missile systems, ordnance transportation devices, etc., and the system described is merely one exemplary application for the invention.

Various representative implementations of the present invention may be applied to any system for projectile propulsion, projectile navigation, projectile guidance, and the like. Certain representative implementations may comprise, for example, an impulse thruster system configured to couple to a projectile and direct the projectile to an intended target according to a guidance kit. Methods and apparatus for fast action impulse thruster may operate in conjunction with a launch system, such as an artillery barrel, and/or an auxiliary control system.

Figure 1:
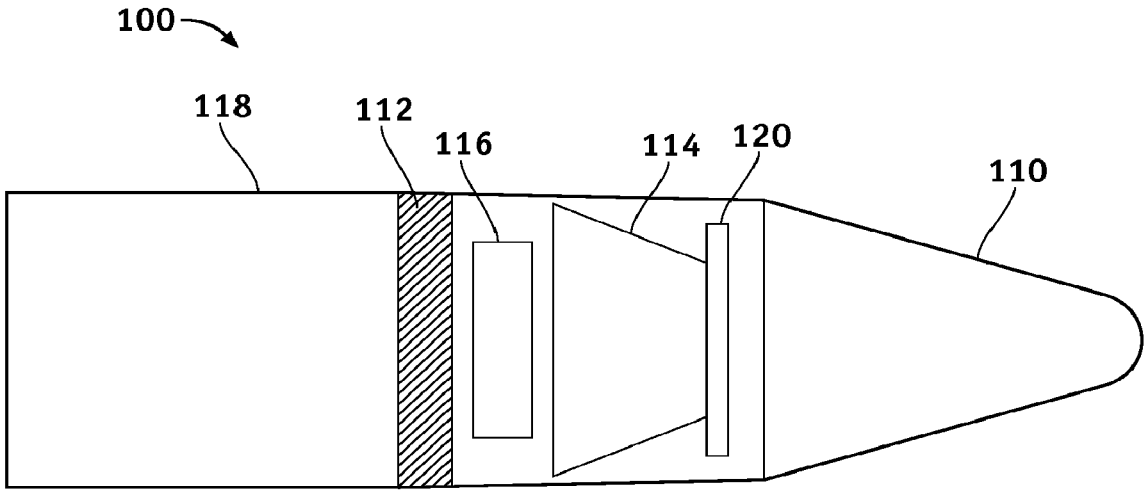
FIG. 1 representatively illustrates a projectile system comprising a projectile, a fast action impulse thruster system, and a guidance system, in accordance with an exemplary embodiment of the present invention.

Referring now to FIG. 1, methods and apparatus for a fast action impulse thruster may operate in conjunction with a projectile 100. The projectile 100 may comprise any system that is configured to travel, either with an on-board propulsion system or ballistically. The projectile 100 may comprise a system to deliver a payload, such as a conventional artillery-fired munition 114 coupled to a fuze 110 and a detonator 120. According to various aspects of the present invention, the projectile 100 may further comprise an impulse thruster system 112 coupled to a guidance system 116. At least a portion of the projectile 100 may be selected from prefabricated, preexisting, and/or off-the-shelf parts and components, such as artillery shells, explosively formed projectiles, naval munitions, grenades, solid fuel rockets, solid fuel thrusters, circuit cards, metal casings, nozzles, control systems, and/or the like. The projectile 100 may comprise one or more subsystems, and conventional components may be modified to operate in conjunction with other systems.

In the present embodiment, the projectile 100 may comprise a spin stabilized projectile comprising a rotational velocity of about 18,000 revolutions per minute (RPM), but other exemplary embodiments may comprise projectiles comprising rotational velocities greater than or less than the RPM's given for the exemplary embodiment. For example, projectiles comprising various masses, lengths, architectural configurations, etc., may comprise other rotational velocities commensurate with the functioning of the projectiles.

In accordance with exemplary embodiments of the present invention, the munition 114 may comprise ordnance configured to detonate in response to a signal from the fuze 110. The munition 114 may comprise any system for delivering an explosive, wherein the explosive may comprise, a conventional explosive, an unconventional explosive, such as nuclear material, a chemical agent, a biological agent, and/or the like. The munition 114 may also be configured to provide ordnance comprising a specified impact characteristic, such as temperature, electromagnetic output, pattern of particulate matter, electronic interference pattern, pressure, and/or the like. The munition 114 may further be configured for insensitive munition features, such as to accommodate handling during delivery to a launch vehicle.

The munition 114 may comprise various materials, dimensions, and/or geometries. In one example, the munition 114 may comprise a maximum allowable circumference for a given artillery barrel and a specified detonation characteristic. Among other examples, the munition 114 may comprise a specified mass of high explosive material. In still other examples, the mention 114 may comprise an explosively formed projectile configured to operate within a specified geometry, such as a 105 mm artillery projectile, a mortar barrel, and/or the like.

In accordance with exemplary embodiment of the present invention, the fuze 110 may be configured to selectively actuate the munition 114. The fuze 110 may comprise any system for triggering a munition 114, such as the detonator 120, a switch, a preliminary explosive, a squib, and/or the like. The fuze 110 may trigger the munition 114 in response to a specified condition, such as, after a specified passage of time from launch, upon achieving a specific altitude, after reaching a specific position along a trajectory, upon experiencing a specific pressure, and/or the like. In the present embodiment, the fuze 110 may comprise a standard 105 mm artillery fuze disposed in a fuze well of the projectile 100. As another example, the fuze 110 may be a naval fuze disposed toward the fore portion of the projectile 100, such as within a nose-one. Furthermore, depending on the munition 114 or other appropriate criteria, the fuze 110 may be configured to chemically, mechanically, and/or electrically actuate the munition 114.

In accordance with an exemplary embodiment of the present invention, the projectile 100 may comprise a casing 118 to at least partially contain the munition 114, the fuze 110, and/or other projectile components. The casing 118 may comprise any appropriate casing, such as a conventional shell comprising an interior cavity to contain the munition 114. In the present exemplary embodiment, a steel casing 118 may: contain a high explosive munition 114, receive a standard artillery fuze 110, and provide the high explosive munition 114 with insensitive munition characteristics. An exemplary casing 118 may also be configured to fragment and/or shatter in response to detonation of the munition 114. Referring to FIG. 1 of the present embodiment, the casing 118 may be configured to contain the impulse thruster system at a position that, in one example, is at or near the center of mass of the projectile 100.

Figure 2:
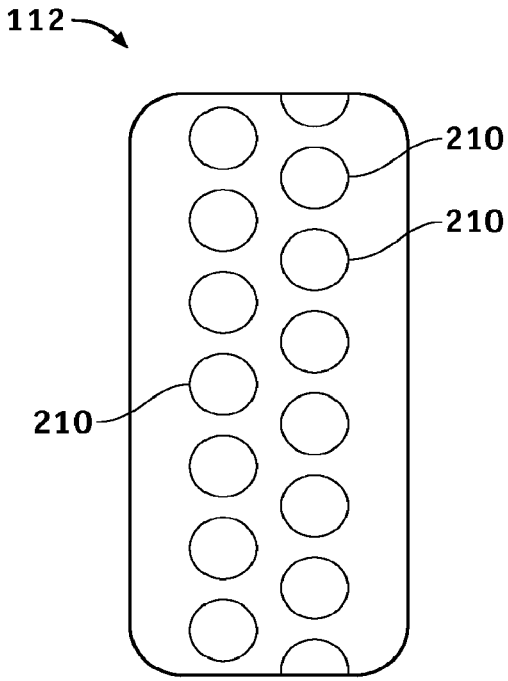
FIG. 2 representatively illustrates the location and spacing of fast action impulse thrusters in accordance with the exemplary embodiment of the present invention.

In accordance with exemplary embodiments of the present invention, the projectile 100 may comprise the impulse thruster system 112, wherein the impulse thruster system 112 may be configured to impart a force off the longitudinal axis of the projectile 100, such as a force that may be substantially transverse to the longitudinal axis of the projectile 100. The force provided by the impulse thruster system 112 may be supplemental to any force imparted by a launch system, such as an artillery barrel launch system. The impulse thruster system 112 may comprise any system for generating force, including a mass ejection drive system, a solid fuel rocket engine, a jet engine, a control surface, and/or the like. Referring to FIG. 2 of the present embodiment, the impulse thruster system 112 may comprise at least one or more fast action impulse thrusters 210 arranged, for example, radially, around the longitudinal axis of the projectile 100, at or near the center of mass of the projectile 100, and/or any other positional configuration to impart the force as discussed. The impulse thrusters 210 may be configured to react within an impulse period that is faster than the rotational velocity of the projectile 100.

The fast action impulse thrusters 210 may be arranged such that the force generated by their activation acts substantially transverse to the longitudinal axis of the projectile 110 and/or through the center of mass of the projectile 100. In such an arrangement, actuation of the impulse thruster system 112 may be configured to produce a substantial force to alter the course of the projectile during flight, yet prevent producing a significant torque on the projectile 100.

The number, properties, and arrangement of the fast action impulse thrusters 210 may be configured in any suitable form. In some projectiles 100, multiple rows of fast action impulse thrusters 210 may be arranged along the surface of the projectile 100, but in other exemplary embodiments a single row of fast action impulse thrusters 210 may be implemented. In addition to single or multiple rows, the number of fast action impulse thrusters 210 in a row may also be varied. Further, the impulse thruster system 112 may comprise various types of fast action impulse thrusters 210 to provide impulses of various magnitudes, durations, directions and/or the like.

Figure 3A:
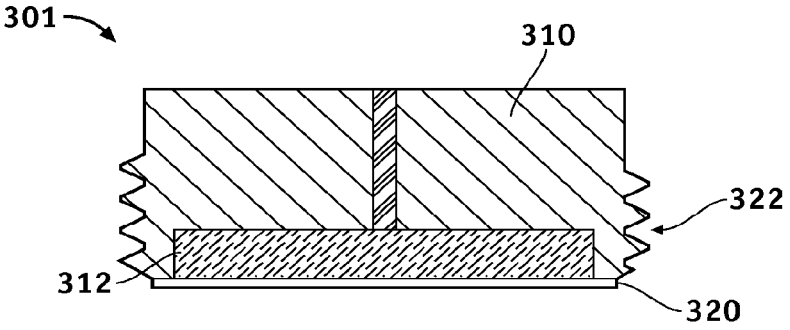
FIG. 3A representatively illustrates an energetics assembly in accordance with the exemplary embodiment of the present invention.
Figure 3B:
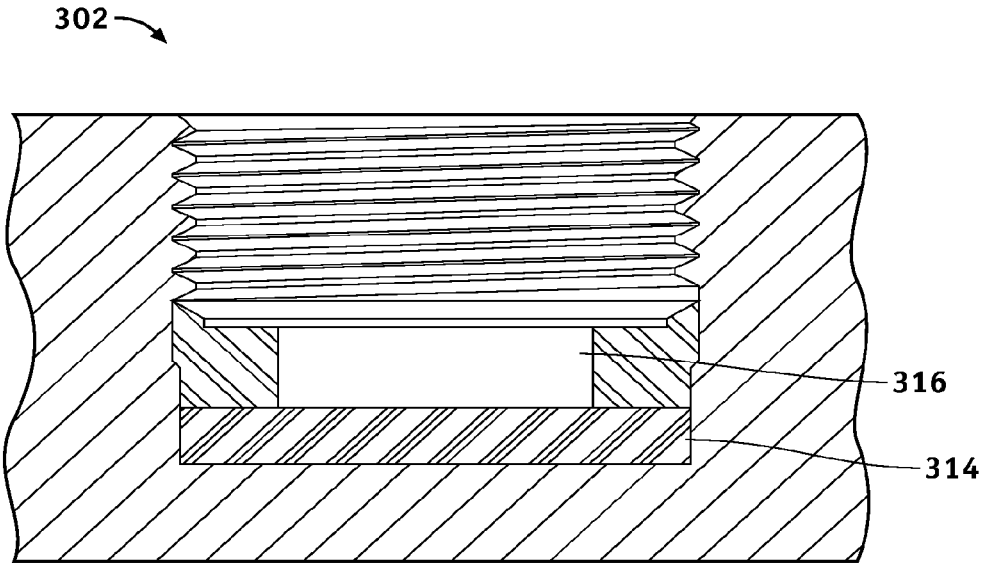
FIG. 3B representatively illustrates an electronics assembly in accordance with the exemplary embodiment of the present invention.
Figure 3C:
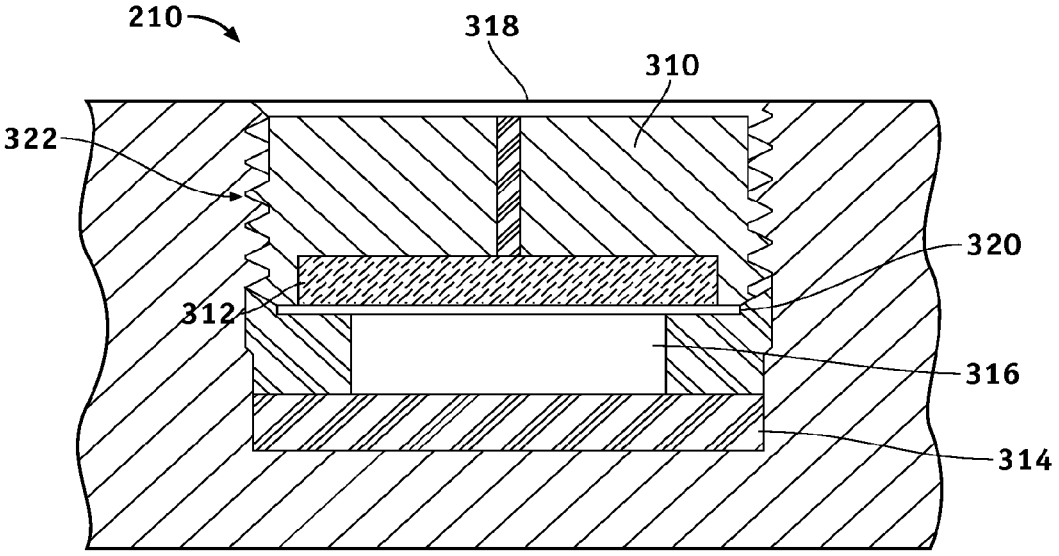
FIG. 3C representatively illustrates the fast action impulse thruster assembly in accordance with the exemplary embodiment of the present invention.

In accordance with exemplary embodiments of the present invention and with reference now to FIGS. 3A, 3B, and 3C of the present embodiment, the fast action impulse thrusters 210 may individually comprise an energetics assembly 301 and an electronics assembly 302. The energetics assembly 301 and the electronics assembly 302 may be partitioned to increase system safety. Among various exemplary embodiments, the electronics assembly 302 may not contain any energetic material, thereby allowing it to be tested during assembly and prior to installation of the energetics assembly 301. In a complete fast action impulse thruster 210 assembly, the energetic material located in the energetics assembly 301 may line up with and complete the train in the electronics assembly 302.

In accordance with exemplary embodiments of the present invention, the energetics assembly 301 may be configured to eject at least one mass from the projectile 100 at high velocity. The energetics assembly 301 may comprise any system for ejecting the at least one mass such as, an explosive ordnance or exhaust gases from the projectile's propellant. In the present embodiment, the energetics assembly 301 may develop thrust by primarily ejecting the at least one mass through the explosion of insensitive munitions. The resulting force is several times larger than methods which rely on exhaust gases alone. Referring to FIG. 3A, the energetics assembly 301 may comprise an energetic 312, a flyer plate 310, and a seal 320. The flyer plate 310 substantially covers the energetic 312 on one end and the seal 320 substantially covers the energetic 312 on the other end.

In accordance with exemplary embodiments of the present invention, the flyer plate 310 may comprise a mass that may be ejected from the body of the projectile 100 such that the resulting force of the ejection may be used to alter the trajectory of the projectile 100. The flyer plate 310 may comprise of any suitable natural or synthetic materials, such as metals, alloys, ceramics, high density polymers, composites, and the like. In one embodiment, the mass may comprise a metallic material ranging from about 0.06 ounces to about 8 ounces.

For example, in an exemplary configuration, each of the plurality of fast action impulse thrusters 210 may comprise a metallic flyer plate 310 comprising a mass of about 0.4 ounces that is configured to be ejected from the projectile 100 at a high velocity when the fast action impulse thruster 210 is activated. The fast action impulse thruster 210 may provide an impulse from about 10 to about 20 microseconds in duration. The combination of the low mass of the flyer plate 310 and the high velocity with which it is ejected, may create a momentum exchange to alter the trajectory of the projectile 100 as described.

Referring to FIG. 3A, in the present embodiment, the flyer plate 310 may further be configured to secure to the impulse thruster system 112 via engagement threads 322, wherein the engagement threads 322 may shear off when the fast action impulse thruster 210 is activated. The flyer plate 310 may, however, be configured to secure to the impulse thruster system 112 to the projectile 100 in any suitable manner to allow the flyer plate 310 to be ejected from the projectile 100, such as with a pin, a hook, a spring, a compression fitting, and/or the like.

In accordance with exemplary embodiments of the present invention, the energetic 312 may comprise an explosive charge to cause the ejection of the flyer plate 310 from the projectile 100. The energetic 312 may comprise any system or component necessary to provide the necessary impulse force to eject the flyer plate 310 from the projectile 100. Among various embodiments, a typical barrel launched projectile 100 may be imparted with a rotational velocity that is used to help stabilize the projectile 100 during flight, and the impulse reaction time of the energetic 312 may comprise an important factor as the rotational velocity of the projectile 100 increases. For example, in the present spin stabilized projectile 100 embodiment, the energetic 312 may comprise an insensitive explosive comprising an impulse reaction time of about 100 microseconds or less. The impulse reaction time may provide for actuation of the energetic 312 within plus or minus fifteen degrees of the desired position on projectiles comprising a rotational velocity up to about 18,000 revolutions per minute.

Among various exemplary embodiments, the amount of the energetic 312 in a fast action impulse thruster 210 may vary depending on the mass of the flyer plate 310 or on the desired impulse force. The impulse thruster system 112 may comprise fast action impulse thrusters 210 with a single energetic 312 charge or comprise energetics 312 that may comprise several different levels of charge. Alternative embodiments may comprise an energetic 312 comprising a slower reaction time that corresponds to specific rotational characteristics of a given projectile 100.

In accordance with exemplary embodiments of the present invention, the electronics assembly 302 may activate the energetic 312 thereby causing the Over plate 310 to eject from the projectile 100. The electronics assembly 302 may comprise any system that can receive an activation signal from the guidance system 116 and then activate the energetic 312. Referring to FIG. 3B in the present embodiment, electronics assembly 302 may comprise an initiator 316 and a control circuit 314.

In accordance with exemplary embodiments, the initiator 316 may trigger the energetic 312. The initiator 316 may comprise any system or component to activate the energetic 312 such as a mechanical or electromechanical detonator, an exploding bridgewire detonator, a slapper detonator, and/or the like. In the present embodiment, the initiator 316 may comprise a low energy exploding foil initiator that is coupled to the energetic 312 and may be configured to activate the energetic 312 after receiving a signal from the control circuit 314. Alternative embodiments for the initiator 316 may comprise using a detonator or microelectromechanical system coupled to a safe and arm device for each energetic 312. The safe and arm device may provide safe handling properties to allow handling the initiator 316 by personnel. For example, safe handling may be provided electronically by use of an exploding foil "slapper" detonator or mechanically by use of a microclectromechanical safe and arm.

In accordance with exemplary embodiments, the control circuit 314 may transmit a signal to the initiator 316 in response to a trigger or event from the guidance system 116. The control circuit 314 may be configured in any manner to provide the necessary input to the initiator 316, such as by a full integrated circuit assembly or the triggering signal may be sent by stand alone electrical components, such as capacitors and/or the like. Referring to FIG. 3 of the present embodiment, the control circuit 314 may be coupled to the initiator 316, but alternative embodiments may comprise the control circuit 314 positioned separate from the impulse thruster system 112. Among various embodiments, the control circuit 314, the initiator 316, the impulse thruster system 112. as well as any other components described may communicate among each other by either wired or wireless signals to activate the initiator 316.

In accordance with exemplary embodiments of the present invention, the guidance system 116 may control the operation of the impulse thruster system 112. The guidance system 116 may also control the operation of the projectile 100 according to any appropriate mechanisms and/or criteria. For example, the guidance system 116 may determine the position of the projectile 110 and/or a time of flight of the projectile 100, and selectively actuate the impulse thruster system 112 to achieve a desired position and/or trajectory. The guidance system 116 may also control the arming of the fuze 110 by providing position data.

In the present embodiment, the guidance system 116 may comprise a position sensor and a rotation sensor, such as an accelerometer, a velocimeter, a magnetometer, a satellite positioning system, an optical sensor, and/or the like. The two sensors may be used to identify the position of the projectile 100 in space and/or the rotational velocity of the projectile 100. This information may then be used to determine if the impulse thruster system 112 is should be activated to alter the trajectory of the projectile 100. When actuation of the impulse thruster system 112 is deemed appropriate, the guidance system 116 calculates the amount of force required to alter the trajectory, which energetic 312 will be fired, as well as the timing of the firing.

In an exemplary embodiment, if the guidance system 116 determines an initial trajectory of the projectile 100 will result in the projectile 100 landing ten meters to the left of an intended target, the guidance system 116 will calculate the rotational velocity of the projectile 100, the necessary force required to correctly alter the trajectory of the projectile 100, and then actuate the impulse thruster system 112 to fire off the appropriate energetics 312. The fired energetic 312 will then eject the flyer plates 310 when they rotate to a position such that the resulting incremental forces will redirect the projectile 100 to an arrival point ten meters to the right.

Among various exemplary embodiments, the guidance system 116 may also communicate with other systems. For example, the guidance system 116 may be configured to selectively actuate other systems on the projectile 100 such as control surfaces. As another example, the guidance system 116 may be configured to receive and/or transmit information tracking systems, satellite positioning systems, and/or the like.

In accordance with exemplary embodiments of the present invention, in operation, the projectile 100 may be initially positioned, packaged, transported, and/or installed in a launch vehicle such as an artillery barrel, warship, and/or the like. A target may then be selected, such as by receiving position information via real-time intelligence and/or surveillance operations, approximating target position information based on dated intelligence and/or surveillance operations, and/or via sensory equipment.

Among various exemplary embodiments, providing the intended target's position information to the guidance system 116 may be accomplished in various manners. For example, providing the guidance system 116 of the projectile 100 with the targets position information may comprise, directly transferring the target's position information to the projectile 100 prior to launch, transmitting the target's position information during flight of the projectile 100, and/or calculating the target's position information via onboard systems after initiation of the projectile 100. The specific manner to provide the guidance system 116 with the target's position information may depend upon the type of target to be destroyed. For example, while a fixed target comprising a known position may be appropriate for pre-initiation (pre-launch) input into the guidance system 116, a moving target may comprise a variable position, thus an on-board tracking device such as an optical tracking system (not shown) may be used to provide the guidance system 116 with the target's position information.

In accordance with exemplary embodiments of the present invention, the projectile 100 may be prepared for launch, for example by aligning a launch vehicle to aim the projectile 100 at a specified (intended) target, triggering the launch vehicle, and/or the like. For example, the projectile 100 may be loaded and triggered via an artillery piece, a shoulder-fired rocket, or any other appropriate launch system. The projectile 100 may further be configured such that the projectile 100 translates and/or rotates toward the intended target.

Among exemplary embodiments, the projectile 100 may be self-guided or remotely guided towards the intended target. For example, a projectile 100 that is self-guided may compare its position and/or orientation relative to an intended target's position and adjust the projectile's position and/or orientation accordingly. In the present embodiment, the guidance system 116 may calculate the guidance parameters of the projectile 100 by receiving guidance signals, such as global positioning system signals. Alternatively, the guidance system 116 may receive guidance information from an onboard inertial guidance system, an onboard sensory device, such as an optical sensor, and the like. Guidance information may comprise linear and/or angular acceleration, linear and/or angular velocity, rate of linear and/or angular acceleration, rotational velocity, and/or the like. Such guidance information may pertain to the position, acceleration, velocity, rotation rate of the projectile, and/or the like, for the projectile 100 at a particular time, and in some embodiments the guidance information may be calculated for a future time. In addition, such guidance information may be gathered over multiple time intervals to determine the actual position, acceleration, velocity, and/or the like, for the projectile 100.

In accordance with exemplary embodiments, the guidance system 116 may evaluate position information. For example, if the trajectory of the projectile 100 is such that both range and accuracy are adequate to impact the target, no action may be necessary. However, if the trajectory of the projectile 100 is such that at least one of the range and accuracy is inadequate to impact the target, the impulse thruster system 112 may be actuated.

In accordance with exemplary embodiments, the guidance system 116 may selectively actuate the impulse thruster system 112 to alter the flight of the projectile 100 to increase the likelihood of striking the target. For example, the impulse thruster system 112 may be actuated in short bursts when specific fast action impulse thrusters 210 are in the appropriate position. The guidance system 116 may use the rotational velocity of the projectile 100 and accuracy data to determine how much force is required to alter the trajectory and at what direction on the projectile 100 that force should be imparted. The guidance system may then signal the impulse thruster system 112 to initiate the appropriate energetic 312 when the energetic 312 has rotated into the desired position. When the energetic 312 is actuated it ejects the flyer plate 310 and the resulting momentum exchange imparts a force to the projectile 100 resulting in an alteration to the trajectory of the projectile 100. This process is then repeated until enough flyer plates 310 have been ejected from the projectile 100 to result in a complete course correction to the projectile 100.

In accordance with exemplary embodiments, the process of determining the position of the projectile 100, comparing the position of the projectile 100 to a desired position, for example, an intended target, and adjusting the position of the projectile 100 may be repeated while the projectile 100 is in flight. Upon arriving at the intended target, the munition 114 may be activated, for example by programming the fuze 110, detonating the munition 114, and/or the like. Actuation of a munition 114 may be an automatic response to the position of the projectile 100, such as in response impact of the projectile 100 with the intended target, proximity of the projectile 100 to the intended target, a specified time interval from initiation of the projectile 100, a specified elevation of the projectile 100, and/or the like. Alternatively, the fuze 110 may be in communication with the guidance system 116 such that position information as determined by the guidance system 116 may selectively trigger the munition 114 via the fuze 110.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. An impulse thruster system for guiding a projectile, comprising:

a mass device removably connected to the projectile and configured to be ejected from the projectile and impart a force to alter a trajectory of the projectile;

an energetics assembly engaging the mass device, wherein the energetics assembly is configured to explosively eject the mass device away from the projectile;

an electronics assembly adjacent to the energetics assembly and configured to activate the energetics assembly;

a safe and arm device coupled with the electronics assembly, wherein the safe and arm device prevents unintentional activation of the energetics assembly; and a guidance system linked to the electronics assembly, wherein the guidance system is configured to provide an activation signal to the electronics assembly.

2. The impulse thruster guidance system of claim 1, wherein the mass device is connected to the projectile with engagement threads that are configured to shear off when the mass device is ejected from the projectile.

3. The impulse thruster guidance system of claim 1, wherein the mass device comprises a mass of less than one ounce.

4. The impulse thruster guidance system of claim 1, wherein the energetics assembly is configured to explosively eject the mass device from the projectile body comprising an impulse time less than or equal to about 100 microseconds.

5. The impulse thruster guidance system of claim 1, wherein the electronics assembly further comprises:

an initiator linked to the safe and arm device and positioned adjacent to the energetics assembly, wherein the initiator is configured to activate the energetics assembly; and a control circuit connected to the initiator, wherein the control circuit is configured to activate the initiator.

6. The impulse thruster guidance system of claim 5, wherein the initiator comprises an exploding foil adapter.

7. The impulse thruster guidance system of claim 1, wherein the impulse thruster system is configured to apply a force to a center of mass of the projectile.

8. The impulse thruster guidance system of claim 1, further comprising a rotation sensor system connected to the guidance system, wherein the rotation sensor system is configured to provide a rotational velocity of the projectile to the guidance system.

9. The impulse thruster guidance system of claim 8, further comprising a sealant configured to maintain a separation of the energetics assembly and the electronics assembly.

10. An impulse thruster system for altering a trajectory of a projectile, comprising:

a plurality of flyer plates connected to the projectile, wherein:

each flyer plate comprises:

a first surface;

and a second surface substantially opposite the first surface;

the plurality of flyer plates are disposed along an outer radial surface of the projectile that is substantially aligned with a center of mass of the projectile such that the first surface is substantially flush with an exterior surface of the projectile; and the plurality of flyer plates are configured to be ejected from the projectile and impart a force substantially transverse to a longitudinal axis of the projectile;

a plurality of energetic assemblies, wherein:

each energetic assembly is held in contact against the second surface of one of the plurality of flyer plates; and each energetic assembly explosively ejects the flyer plate away it is held against from the projectile;

a plurality of electronics assemblies, wherein each electronic assembly is located adjacent to one of the plurality of energetics assemblies and configured to activate the energetics assembly it is adjacent to;

a plurality of safe and arm devices, wherein each safe and arm device is integrated with one of the plurality the electronics assemblies, wherein each safe and arm device prevents unintentional activation of the energetics assembly; and a guidance system linked to each electronics assembly, wherein the guidance system is configured to provide an activation signal to each electronics assembly.

11. The impulse thruster guidance system of claim 10, wherein the at least one flyer plate is connected to the projectile with engagement threads that are configured to shear off when the at least one flyer plate is ejected from the projectile.

12. The impulse thruster guidance system of claim 10, wherein the flyer plate comprises a mass of less than one ounce.

13. The impulse thruster guidance system of claim 10, wherein in the energetics assembly is configured to explosively eject the at least one flyer plate from the projectile body comprising an impulse time less than or equal to about 100 microseconds.

14. The impulse thruster guidance system of claim 10, wherein each electronics assembly further comprises:

an initiator coupled to the safe and arm device integrated with the electronics assembly and engaging the energetics assembly secured with the electronics assembly, wherein the initiator is configured to activate the energetics assembly; and a control circuit connected to the initiator, wherein the control circuit is configured to activate the initiator.

15. The impulse thruster guidance system of claim 14, wherein the initiator comprises an exploding foil adapter.

16. The impulse thruster guidance system of claim 10, further comprising a rotation sensor system connected to the guidance system, wherein the rotation sensor system is configured to provide the rotational velocity of the projectile to the guidance system.

17. A method to guide a projectile towards a target location comprising:

disposing at least one mass device along an outer radial surface of the projectile;

locating an energetic material against the at least one mass device;

coupling an electronic assembly to each of the at least one energetic material, wherein each electronic assembly is configured to activate the energetic material;

coupling and a safe and arm device to each electronic assembly, wherein the safe and arm device prevents unintentional activation of the energetic material;

comparing a first trajectory with an estimated impact point of the projectile to the target location;

determining a force to adjust the trajectory of the projectile towards the target location;

calculating the optimum radial position to apply the force based on a rotational velocity of the projectile; and imparting the force on the projectile by activating the energetic material thereby ejecting at least one mass device from the projectile at high velocity.

18. A method to guide a projectile according to claim 17, wherein the imparted force is in substantial alignment with a center of mass of the projectile.

19. A method to guide a projectile according to claim 17, wherein ejecting the at least one mass device comprises an impulse time less than or equal to about 100 microseconds.

20. A method to guide a projectile according to claim 17, wherein the rotational velocity of the projectile is determined by a rotation sensor.

* * * * *